United States Patent [19]

Coggins et al.

[11] Patent Number: 4,540,465

[45] Date of Patent: Sep. 10, 1985

[54] PROCESS FOR CONTINUOUS RECOVERY OF NITRIC ACID/HYDROFLUORIC ACID TITANIUM ETCHANT

[75] Inventors: Dolphus L. Coggins, St. Louis; Walter E. Lindner, St. Louis County, both of Mo.

[73] Assignee: McDonnell Douglas Corporation, St. Louis, Mo.

[21] Appl. No.: 619,224

[22] Filed: Jun. 11, 1984

[51] Int. Cl.[3] ..... C23F 1/00; B44C 1/22; C03C 15/00; C03C 25/06

[52] U.S. Cl. ..... 156/642; 156/345; 156/664; 252/79.3

[58] Field of Search ..... 156/345, 642, 664; 252/79.3; 75/108, 109; 134/13

[56] References Cited

U.S. PATENT DOCUMENTS 3,052,582 9/1962 Snyder ..... 156/642 X 3,666,580 5/1972 Kreml et al. ..... 156/642 X

*Primary Examiner*—William A. Powell

*Attorney, Agent, or Firm*—Gravely, Lieder & Woodruff

[57] ABSTRACT

A process of continuously chemically milling refractory metals, e.g., titanium using a supersaturated milling solution which form a water soluble precipitate, milling at temperatures of 140°-160° F., and using two chemical milling tanks so that the milling solution is pumped from one to the other when the precipitate builds up in the first tank to a predetermined level. The water soluble precipitate is easily and inexpensively disposed of and the process makes more efficient use of chemicals.

8 Claims, 1 Drawing Figure

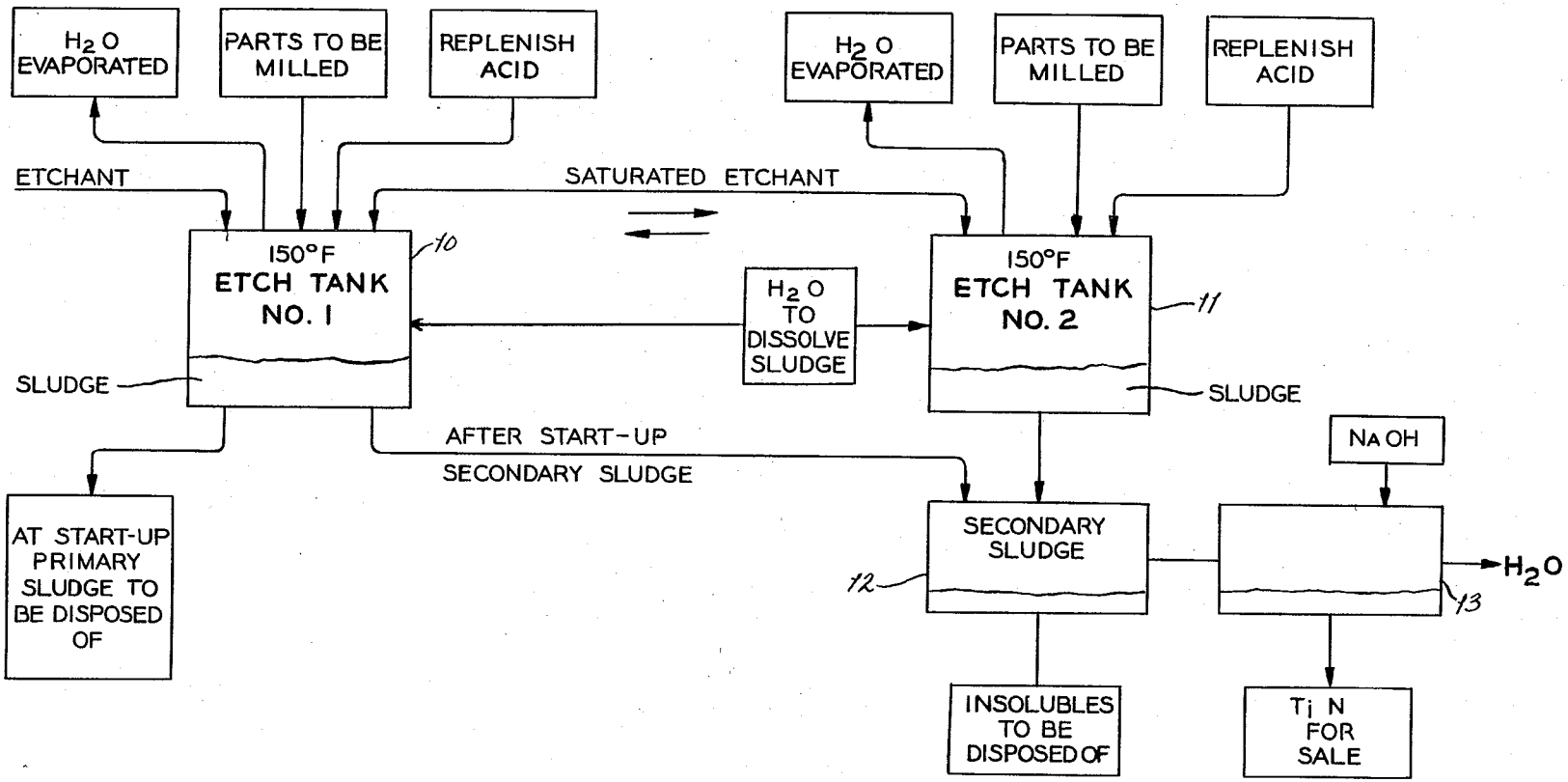
REPLENISH ACID
PARTS TO BE MILLED
$H_2O$ EVAPORATED
150°F ETCH TANK NO. 2
11
SLUDGE
NA OH
$H_2O$
13
Ti N FOR SALE
SECONDARY SLUDGE
12
INSOLUBLES TO BE DISPOSED OF
$H_2O$ TO DISSOLVE SLUDGE
SATURATED ETCHANT
AFTER START-UP
SECONDARY SLUDGE
REPLENISH ACID
PARTS TO BE MILLED
$H_2O$ EVAPORATED
10
150°F ETCH TANK NO. 1
ETCHANT
SLUDGE
AT START-UP PRIMARY SLUDGE TO BE DISPOSED OF

PROCESS FOR CONTINUOUS RECOVERY OF NITRIC ACID/HYDROFLUORIC ACID TITANIUM ETCHANT

BACKGROUND OF THE INVENTION

The present method of chemical milling titanium is a batch process which produces a substantial amount of sludge and waste etchant which must be disposed of at a high cost and with a long downtime in order to make a fresh solution and to heat it to operating temperature.

Presently the chemical milling solution is discarded when the nitric acid concentration is depleted to below 8.0 normal or when the dissolved metal content of the solution reaches 30 to 40 g/l. At this point a portion of all of the etchant is discarded in order to make room for replenishment chemicals. In either case, the cost of chemicals needed to dissolve a pound of titanium is approximately the same.

When disposing of a depleted batch of etchant using the present batch process, 6360 gallons of depleted etchant is produced per 2200 lbs of dissolved titanium per batch. This volume must be neutralized, usually with calcium hydroxide, which increases the volume to 9381 gals. sludge needed to be disposed of. The current cost for removing and disposing of this amount of sludge is almost Seven Thousand Dollars for each 2200 lbs titanium dissolved. As will be explained in detail hereinafter, using the present continuous process, the cost of waste disposal is reduced to about Six Hundred Fifty Dollars per 2200 lbs of titanium dissolved, or less than 1/10 as much. This is in addition to the savings in make-up chemicals. Another savings results from the higher temperature (150° F. versus 130° F. for present processes) which results in evaporation of substantial amounts of water from the etchants. This means that it is not necessary to decant the etch solution when replenishing the activity content of the etchant.

We have found that in chemical milling of titanium and its alloys using conventional nitric acid and hydrofluoric acid etchants, a rock-like precipitate is formed after the etch solution becomes saturated. Using the etchant described in Coggins and Gumbelevicius U.S. Pat. No. 4,116,755, which includes a carbamide, such as urea, a water soluble precipitate forms when chemical milling is continued after the etchant is saturated with dissolved titanium.

In the conventional method, the solution is discarded when it becomes saturated to prevent excessive buildup of deposit in the etch tank, even though substantial amounts of unused acid (which must be neutralized for disposal) remain in the tank.

We are able to provide a continous process using a supersaturated etchant because the precipitate formed in our process can be dissolved in water for disposal. Thus, almost all of the etchant can be utilized and the bulk of solution is never discarded.

Accordingly it is a principal object of the present invention to provide a continuous process for chemical milling of titanium wherein the etchant is utilized at saturation point and is moved from one tank to another when a tank life has been utilized.

Another principal object of this invention is the continuous chemical milling of titanium utilizing a series of etch tanks wherein the cost of sludge removal is less than 1/10 of the normal cost and chemical costs are reduced through reuse of the etch solution and water loss by evaporation so that etchant does not need to be discarded to provide space for renewal of an etch tank.

Still another object of this invention is to provide a process whereby mostly water soluble sludge is produced during the chemical milling conditions and this, when solubilized and neutralized, produces titanium nitride which is saleable to other chemical processors.

A further object is to provide a unique and novel process for waste disposal in a titanium chemical milling process in which chemical make-up costs and sludge disposal costs are greatly reduced without impairing the efficiency of the etching process.

These and other objects and advantages will become apparent hereinafter.

SUMMARY OF THE INVENTION

The present invention comprises a process for chemical milling of titanium and its alloys in a continuous process which results in substantial savings in chemical make-up costs and reduced sludge disposal problems while maintaining the efficiency of the chemical milling process when the etch solution forms a water soluble precipitate when supersaturated with titanium.

DESCRIPTION OF THE DRAWINGS

The drawing is a flow diagram showing schematically the process of this invention.

DETAILED DESCRIPTION

Coggins and Gumbelevicius U.S. Pat. No. 4,116,755 issued Sept. 25, 1978 describe the present state of the art in chemical milling of titanium. The chemical milling solution itself consists of a mixture of nitric acid; hydrofluoric acid or fluoride salts; derivatives of carbonic acid, such as carbamide; phosphoric acid; derivatives of monocarboxylic acids containing alkali metal ions, such as sodium benzoate; and a source of sodium ions compatible with the remainder of the composition, preferably sodium nitrate.

The nitric and hydrofluoric acids are conventional titanium etchants. The carbamide and phosphoric acid reduce the amount of hydrogen absorption in the titanium. The sodium ions assist in the prevention of hard scale formation on the vessel and internal heaters during etching. The addition of sodium benzoate results in a more uniform metal removal rate, thus permitting the producing of high precision parts.

The foregoing can be used to chemically mill other titanium alloys and refractory metals and their alloys. The following alloys in addition to titanium are considered as refractory, columbium, molybdenum, tungsten, and tantalum.

As set forth in detail in U.S. Pat. No. 4,116,755 (and as will be elaborated on hereinafter) the part to be etched is treated in an etch tank containing the etch solution until etching is completed, when it is removed and rinsed. This process is repeated with other parts until the etchant is saturated with dissolved titanium, i.e., approximately 35 g/l.

At this point, in a conventional process either a portion or all of the etchant is discarded in order to make room for replenishment chemicals. This also takes place when the $HNO_3$ concentration is below 8.0 normal. Conventionally the etchant is decanted three times per batch to make room in the etch tank to add more acid to keep the etch solution at operating concentrations. This method incurs a large chemical cost due to the disposal of diluted etchant plus about 16 hours of downtime of the tank in order to clean the tank and make a fresh solution and heat it to operating temperature. The tank etchant now is completely renewed when it has been used to dissolve 2200 lbs of titanium.

We have discovered there are two types of sludge formed in a chemical milling process. The first to form is a relatively water insoluble sludge formed of alloys in the titanium, mainly aluminum oxy-fluoride. After the solution becomes saturated, a second type of water soluble sludge starts to form. This is ammonium titanium fluoride $(NH_4)_2TiF_6$. This sludge is formed when chemical milling is continued under supersaturated conditions.

In the present continuous process diagrammed in the figure, a conventional etchant of U.S. Pat. No. 4,116,755 is formulated in a first tank 10 and parts are chemically milled until the etchant reaches saturation. The temperature of the etchant is between about 140° F. and about 160° F., preferably about 150° F., which is about 20° higher than conventionally used. The saturation point of the tank 10 is about 35 g dissolved titanium/1 etchant at these temperatures.

At this point in the process the etchant can be pumped to a second etch tank 11 where etching is continued under saturated conditions. A primary sludge has collected in the first etch tank 10 which is mostly water insoluble and is made up of aluminum oxy-fluoride and other alloy metals. This sludge is cleaned from the tank 10 and must be disposed of. However, it accounts for only about one-tenth (1/10) of the amount of sludge normally resulting from running a process tank to completion, i.e., until 2200 lbs of titanium has been chemically milled.

Alternatively, milling in the first tank 10 can be continued under supersaturated conditions until the sludge has built to a predetermined point, i.e., until about 2000 lbs of titanium are milled in the first tank 10 before the etchant is removed to the second tank 11. In this preferred form of the invention, a significant amount of ammonium titanium fluoride is formed in tank No. 1 as the etchant is transferred after it reaches the saturation point. The precipitate in the first tank 10 then is a combination of insoluble start-up precipitate and the soluble saturation milling precipitate. The precipitate is disposed of as described hereinafter (and as shown in the FIGURE) for the precipitate of the second tank 11 except that there is much more insoluble material than normally comes from the second tank 11.

The temperature of the etchant in the first tank is maintained at about 150° F. to evaporate water, whereby, when nitric acid is added to the tank to build up the concentration to the desired level, no etchant had to be dumped to provide space for the stronger acid.

Similarly, in the second tank 11, the etchant temperature is about 150° F. to evaporate water and thus avoid dumping etchant as it needs to be replenished with more $HN0_3$.

When about 2200 lbs of titanium have been dissolved in the second etch tank 11 or the sludge build up is at a predetermined point or is sufficient to hamper titanium milling operations, the etchant is pumped back to the first etch tank 10 and the operations described for the second tank 11 are repeated in the first tank 10.

At this point the sludge in the second tank 11 is mainly secondary sludge $(NH_4)_2TiF_6$ which is soluble. Water is added to dissolve the soluble sludge and a slurry is formed with any insolubles in the water. The slurry is pumped to a settling tank 12 where the insolubles are removed for disposal and the solubles are moved to a neutralization tank 13 where sodium hydroxide is added to neutralize the acid and precipitate pure titanium nitride which has a value. The water is then disposed of.

Thereafter in both variations of the invention, this procedure is repeated for the residue in the first tank 10 after the etchant has been repumped back to the second etch tank 11.

Preferably the etch tanks 10 and 11 are used to settle the insolubles from the solubilized $(NH_4)_2TiF_6$ so that there is no need for the tank 12 and the solubles are pumped directly from the etch tanks 10 and 11 to the neutralization tank 13. For ease of disclosure the intermediate tank 12 has been shown in the diagram.

The foregoing cycles can be repeated indefinitely.

Following is a detailed description of the etch composition and the complete etch process for purposes of completing this disclosure. However. these details are known in the art and form no part of the inventive concept of this application.

Following is a specific detailed disclosure of a preferred process of chemically milling titanium, specifically beta titanium alloy. 1. The specimen (beta titanium alloy) is cleaned with trichloroethylene to remove contaminants such as grease, oil, etc. This pre-treatment is necessary for removal of oil, grease, and other contaminants normally found on parts of metal fabrication. The purpose of this cleaning is twofold: (a) to eliminate contamination of chemical milling solution, and (b) to provide a clean surface for proper masking adhesion. Both factors are important to produce acceptable parts. 2. The specimen is dipped into a styrene butadine base maskant. This is a proprietary compound supplied by several specialty chemical companies. The maskant is at room temperature, and has a viscosity of 40 seconds as measured with Zahn No. 5 viscometer. This is a conventional solution and the step is well-known in this art. 3. The coated specimen is permitted to dry at room temperture (about 76° C.) until tack free condition. This takes about 20minutes. 4. Dipping and drying between dipping is repeated three more times to apply four coats of mask which provides about 0.3 mm thick coating. The thickness of the mask is not critical and may vary by as much as 50%, depending upon the size of the parts, shop practices, and depth of chemical milling. 5. After the final coat, the specimen is kept at room temperature for about six hours to permit evaporation of solvents from the coating. 6. Then the masked specimen is baked at 200° F. for 1 hour. This treatment polymerizes the coating and renders it inert to chemical milling solution. The described procedure is well known in the industry, but the methods may vary widely depending on shop practices. 7. The chemical milling template, previously made from steel, is applied to the specimen. The template is designed to serve as a guide for the scribing knife to obtain the chemical milling pattern. The knife used is a commercial type X-Acto scribing knife or any other means to cut the mask, such as a so-called "hot knife," operating on low voltage DC current, or a N/C controlled beer scribing system. It is a well known practice in the chemical milling industry. 8. After all the lines for chemical milling pattern are cut through the maskant, but not into the metal, the template is removed and the maskant, but not into the metal, the template is removed and the maskant is peeled by hand from the areas to be chemically milled. 9. The specimen is transferred into the chemical milling solution. The solution composition is as follows: 682 g of nitric acid, 63 g of hydrofluoric acid, 10 g of phosphoric acid, 40 g of carbamide, 5 g of sodium benzoate, 12 g of sodium nitrate, and water to make a total volume of 1 liter. The solution is at 57° C. and is agitated by means of an electric stirrer or other suitable means such as continuous circulation by pumping. The specimen is suspended in the solution using plastic coated wire or other inert material and is left in the chemical milling solution for 6 minutes. 10. After 5 minutes, the specimen is removed from the chemical milling solution, rinsed with cold water, and the amount of metal removal is measured using a micrometer. 0.46 mm of metal was removed which indicates metal removal rate of 0.0767 mm per minute, per surface. 11. As the desired metal removal is 0.767 mm (half the thickness of the test specimens), the test specimen is re-immersed into the chemical milling solution for an additional 4 minutes to remove the remaining amount of metal and obtain the desired depth of cut (0.767 mm). 12. The specimen is removed, rinsed with cold water and the metal removal is checked again with a mirometer to ascertain that 0.767 mm of metal have been removed. 13. The maskant from areas which had not been chemically milled is removed by hand peeling or any other means well known in the industry such as "peeling" with compressed air.

The chemical milling solution contains between about 126 and about 700 grams of pure nitric equivalent per liter of final solution. Between about 8.8 to about 176.lg, of pure hydrofluoric acid equivalent is used per liter of final solution. While hydrofluoric acid is preferred, fluoride salts such as lithium fluroide, ammonium fluoride, sodium fluoride, potassium fluoride, cobalt fluoride, and the like, may be used.

Carbamide is the preferred carbonic acid derivative and is present in amounts of at least 10 grams per liter of final solution. Preferably the range is from about 20 to about 200 grams per liter. Other carbonic acid derivatives which may be used include urea nitrate, urea oxalate, semicarbazide, carbazide, mixtures thereof and the like.

The milling solution may contain small amounts of pure phosphoric acid in the final etchant solution.

The concentration of sodium benzoate may vary between 1.5 and 24 grams per liter of solution. The preferred concentration is 5 grams per liter. Sodium benzoate can be replaced by other derivatives of monocarboxylic acids containing alkali metal ions.

A suitable source of sodium ions, preferably sodium nitrate, is added to the chemical milling solution to prevent scale formation. Suitable substitutes for sodium nitrate include sodium salts compatible with the remainder of the chemical milling solution. The concentration of sodium nitrate is at least about 2 gm/l and may vary from about 0.5 to about 24 grams per liter. The preferred concentration of sodium ions of about 0.541 to about 6.49 g/l derived from sodium nitrate.

The invention is intended to cover all changes and modifications of the examples of the invention herein chosen for purposes of the disclosure, which do not constitute departures from the spirit and scope of the invention.

What is claimed is:

1. A process for chemically milling titanium and its alloys comprising:

(a) forming a chemically milling solution saturated in titanium in a first etch tank;

(b) immersing titanium containing parts in the solution while maintaining the solution saturated in titanium; and (c) forming a water soluble precipitate in the tank;

2. The process of claim 1 wherein the chemical milling solution contains a derivative of carbonic acid.

3. The process of claim 1 wherein the process is continuous and including the step of transferring the etchant to a second tank after a predetermined amount of precipitate has been formed in the first etch tank.

4. The process of claim 3 including the step of removing the sludge from the first etch tank, chemically milling in the second etch tank under supersaturated conditions, terminating the chemical milling in the second etch tank at a predetermined level of precipitate, and transferring the remaining chemical milling solution back to the first etch tank and repeating the steps of chemically milling under supersaturated conditions, stopping chemical milling at a predetermining point, removing and dissolving precipitate and returning chemical milling solution to the second tank.

5. A process for continuously chemically milling titanium and its alloys comprising the steps of:

(a) forming an etch solution containing a carbonic acid derivative in a first tank;

(b) etching titanium parts in said first tank until the etchant is substantially saturated;

(c) transferring the etchant to a second etch tank;

(d) treating titanium parts in said second etch tank with the etchant substantially supersaturated;

(e) terminating the chemical milling in the second tank when the sludge has built up to a predetermined point;

(f) transferring the etchant to the first tank;

(g) treating the sludge in the second tank with water to solubilize the part of the sludge which is $(NH_4)_2TiF_6$;

(h) separating the soluble part of the sludge from the insoluble parts;

(i) neutralizing the soluble part; and (j) recovering titanium nitride as a precipitate.

6. The process of claim 5 including the step of removing the sludge in the first tank prior to returning the etchant to it.

7. The process of claim 5 including the step of repeating steps (d) and (e) in the first tank, returning the etchant to the second tank, and repeating steps (g) to (j) in the first tank.

8. The process of claim 5 wherein the chemical milling solution is at 140°–160° F. during milling.

* * * * *